United States Patent [19]

Sim et al.

[11] 4,341,051

[45] Jul. 27, 1982

[54] BUILDING STRUCTURE AND PROCESS OF BEAM ASSEMBLY THEREIN

[76] Inventors: William J. Sim, 4068 Arjay Cir., Ellicott City, Md. 21043; Ronald M. Marth, 5409 Lucy Dr., Waldorf, Md. 20601

[21] Appl. No.: 217,695

[22] Filed: Dec. 18, 1980

Related U.S. Application Data

[62] Division of Ser. No. 136,390, Apr. 1, 1980, Pat. No. 4,296,048.

[51] Int. Cl.[3] ..... E04B 1/38

[52] U.S. Cl. ..... 52/702; 52/250; 52/721; 52/741

[58] Field of Search ..... 52/250, 721, 722, 741, 52/702, 396, 251, 252, 698

[56] References Cited

U.S. PATENT DOCUMENTS

| | | | |
|---|---|---|---|
| 625,427 | 5/1899 | Stewart, Jr. et al. | 52/702 X |
| 3,420,560 | 1/1969 | Pfahning | 52/702 X |
| 3,465,484 | 9/1969 | Zaldastani et al. | 52/250 X |
| 3,604,177 | 9/1971 | Clyne | 52/250 X |
| 3,837,135 | 9/1974 | Zachman | 52/702 |

*Primary Examiner*—Carl D. Friedman

*Attorney, Agent, or Firm*—E. Barron Batchelder

[57] ABSTRACT

A support bracket for ends of concrete beams, particularly precast ones, more especially the bottoms of T-beam legs positioned on a support beam of similar material, including inverted U-shaped straps inserted over the support beam on either side of the T-beam, and a supportive angle member connected to the straps and in supportive engagement with the underside of the T-beam leg, with a gasket therebetween, and the method of repairing joints between crossing engaging ends of concrete beams.

15 Claims, 8 Drawing Figures

BUILDING STRUCTURE AND PROCESS OF BEAM ASSEMBLY THEREIN

This is a division of application Ser. No. 6,136,390, filed Apr. 1, 1980, now U. S. Pat. No. 4,296,048.

Intersections of beams, or cross-over points of the same, especially when the beams are constructed of precast concrete material, or similar substances; or in situations where in use there may be a tendency to deteriorate, such as when a material is caused to fall or pass over and through a series of the beams formed as a framework in order to break up the material for cooling purposes, the deterioration of the beam material must be prevented, or the beam work must be periodically maintained and/or repaired in order to prevent failure in the structure. Such a failure can cause possible resultant danger to work personnel around the structure, and/or danger in a surrounding environment. Lengthy shut down periods of the apparatus for time consuming and costly repair, and/or costly rebuilding of portions of the structure, to overcome the damage caused by deterioration are highly undesirable, not only economically, but may also result in discomfort or inconvenience in persons of an area serviced by the apparatus.

Such apparatus, as an example of a type having a construction of a nature hereinabove referred to may, although application of the invention is not limited thereto, be a cooling tower such as used by Pepco (Potomac Electric Power Company) in its Chalk Point, Md. #3 construction.

A cooling tower can in some types consist in a huge 400-foot structure used for cooling steam from, for example, a plant's boiler wherein water from a station is pumped into the tower, up to a 60-foot level where it passes over and through a series of concrete beams. The water then falls down the sides of the tower and through a sieve-like "fill" of concrete and asbestos. This action serves to break up the water for additional cooling.

The construction and operation of such cooling towers are well known and will not be shown and described in detail hereinafter, only sufficient disclosure will be made herein to show a preferred use of the bracket, its construction and method of installation.

The partial cooling tower shown as a background or a setting for the invention, and as referred to above as being in current use by Pepco at their Chalk Point plant, is a cross flow natural draft hyperbolic cooling tower B of a type designed and built by The Marley Company, of Mission, Kans., and reference is here made to, and the disclosures incorporated herein by reference, of the apparatus shown and described in patents of this company, namely, U.S. Pat. Nos. 3,617,036, 3,756,088, 3,834,681, 3,764,121, 3,880,964, 3,894,127, 4,032,604, 4,048,265, 4,129,625. Additional existing patents show other types of structures such as cooling towers in which the invention might serve a useful purpose. The drawings in this application refer to a type known as "a Marley class 700 crossflow natural draft hyperbolic cooling tower" of The Marley Company.

Problems arising, and their solution in accordance with the present invention will be more readily shown, illustrated and described in the accompanying drawings and detailed description.

DRAWINGS OF A PREFERRED EMBODIMENT

FIG. 3 is a fragmentary cross-sectional view disclosing a condition of a faulty precast concrete beam intersection which can occur in apparatus such as water towers and the like;

DESCRIPTION OF AN EMBODIMENT OF THE INVENTION

Figure 1:
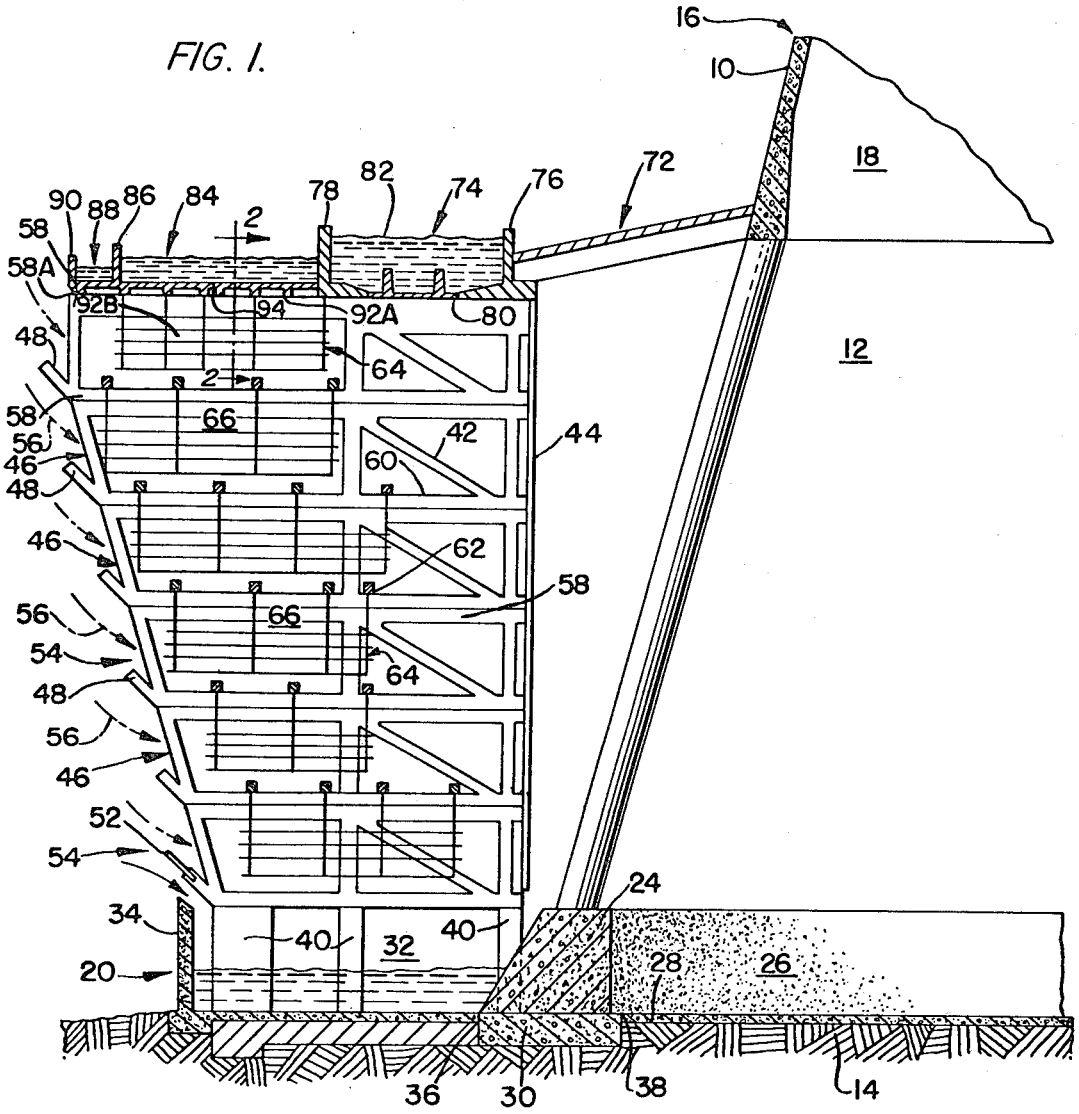
FIG. 1 is a fragmentary view, partly in section and partly in elevation, of a cooling tower incorporating the principles and construction of the present invention.

Referring to the drawings, in which some of the figures serve as a setting only for illustration of a practical application of the invention, a fragmentary portion of a cooling tower shell is shown at 10, reference being made to the aforementioned patents for an additional showing of a hyperbolic cooling tower of a crossflow natural draft type, and having a shell support column 12. The tower is situated on a proper soil support at 14, the hyperbolic tower, generally 16, has a hollow upper end 18 and a base or cooling ring 20. The base includes an inner basin 26, formed by basin slab 28, and appropriate pilings are used at 30. The remainder of the interior of the hyperbolic tower construction can be of any desired type, such as shown in some of the aforementioned patents, and serves as a chimney to pull air into and through the bottom or base section.

Exterior of the lower or inner basin there is a properly supported cold water basin 32 with a curbwall 34. Appropriate PVC waterstops can be provided at 36, 38, and other areas where necessary.

Radial bent support piers 40 are provided which support in operative position a plurality of superposed panels, referred to as precast bent panels, 42 and a forming and supporting precast circumferential framing 44. A plurality (not shown) of ACB eliminators in noncombustible GRP supports and asbestos honeycomb eliminator panels are superposed proximate precast circumferential framing 44 in a usual manner, all as shown in some of the aforementioned patents.

Reference is here generally made to the construction shown in U.S. Pat. No. 3,834,681. Similarly there is shown herein a plurality of the precast bent panels 42 which are operatively superposed on one another as shown in FIG. 1, supported on the radial bent support piers 40 which in turn are disposed in the cold water basin 28 and inwardly of curbwall 34. The bent panels in turn are connected or conjoined with an equal plurality of superposed radial extending horizontal piers 46. Precast concrete louver supports 48 are jointed upwardly and angularly joined into the open sided exterior walls 50 of the horizontal piers and may have flow directing fins or louvers 52 or the like, only a lowermost one being shown for clarity. The general air directional flow is indicated by full line arrows 54, with induced air flows, caused by the hollow tower upper end 18, being indicated by broken line arrows at 56. The precast bent panels include upper radial beams 58 which form a significant portion of the present invention. The lower radial beams 60 in the shown construction support, collectively, a so called fill structure 62, which consists of a plurality of fill sections 64, each carried by one of the horizontal piers 46 and mounted on or suspended below the lower radial beams 60. Such fills are broadly shown in U.S. Pat. Nos. 3,758,088; 3,894,127; 4,129,625 and others of the aforementioned patents.

Generally speaking, the cooling tower fill structure consists of a hanger grid assembly generally designated 68 (See FIG. 2), supported or suspended by twisted, or other types, hangers 70 which operatively support the grid, and which can include a plurality of pads such as asbestos, (not shown) to break water streams, falling through the grid, into fine particles across the fill by natural draft-the air flow arrows indicating air flow action, and thereby serving to cool water as will appear hereinafter.

Figure 2:
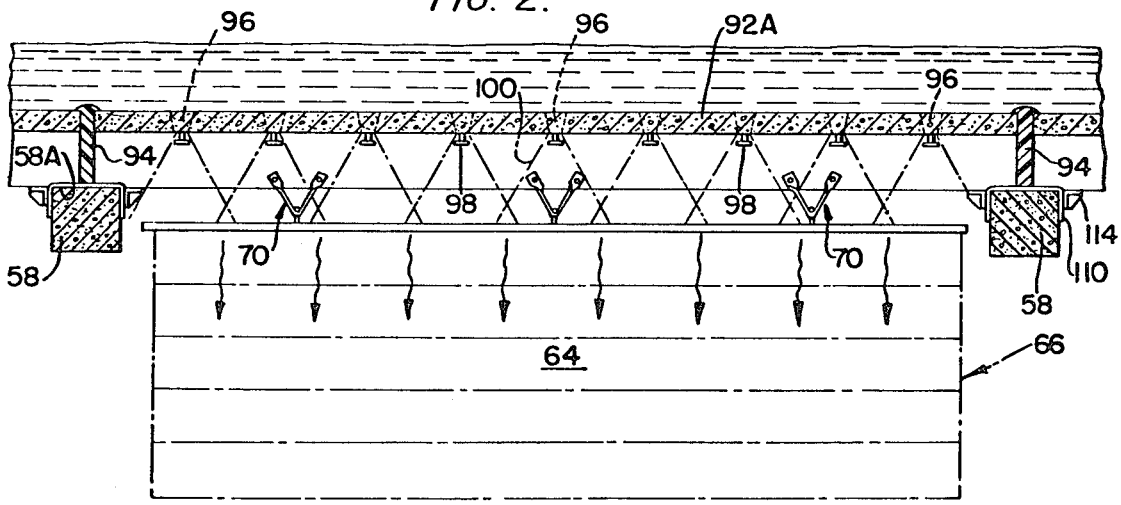
FIG. 2 is a fragmentary view, mostly in elevational cross-section of the tower base or cooling ring of a construction as in FIG. 1.

At the upper end of the base or cooling ring, referring to FIGS. 1 and 2, there is a hot water collection and distribution system generally designated 72. Hot water is pumped up, in the model in use and shown, approximately sixty (60) feet from the base to a precast flume 72 anchored to the shell 10, and thence discharges to a precast concrete water distribution flume 74, which includes inboard, 76, and outboard, 78, flume walls mounted on opposite sides of an inverted T-beam section 80. This inverted T-beam is of a double leg configuration, of precast concrete, and serves as an initial distribution water flume. Hot water, the level of which is indicated at 82, runs over the outboard flume wall 78 during operation and into a precast concrete distribution basin 84 defined between flume wall 78 and inner distribution basin inner wall 86. A precast concrete outer distribution basin 88 extends between wall 86 and an outer wall thereon 90. The outer distribution basin 88 serves as a deicer unit in a known manner.

The bottoms of the inner and outer precast concrete distribution basins are formed with a plurality of bottom basin panels which understandably are like rings to conform with the shape of the hyperbolic cooler, and have one or more perforated bottom basin panels. The inner basin, as shown, includes two adjacently placed triple T-beam panels 92A, 92B, these bottom panels, as seen in FIG. 2, are preferably formed in sections for ease of concrete casting, and ease of assembly. The sections can have sealing expansion rings or members 94 therebetween for obvious reasons. The bottom panels in the distribution basins, with the precast openings or perforations therethrough at 96, have distribution nozzles 98 operatively inserted therein. Such nozzles are well known in the art and serve to spread or spray the water passing through the perforations, as indicated by dash lines 100. The so spread water then passes through and along the open structure forming the grid wherein it is further broken up and splashed in fill section 66, 68, and due to the counter flow of air, as indicated, will be more effectively cooled before falling into the cool water basin at 32.

Figure 7:
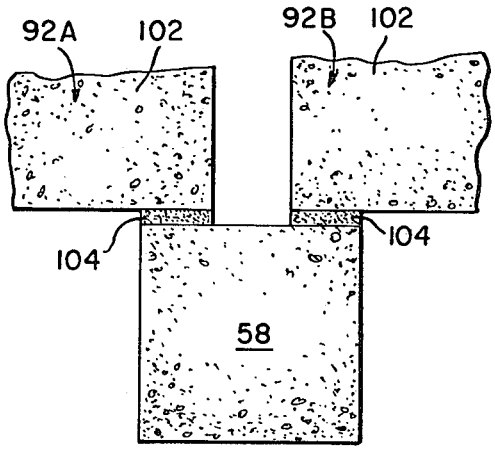
FIG. 7 is a fragmentary sectional view of intersecting beams having neoprene support pads inserted therebetween to overcome frictional wear.
Figure 8:
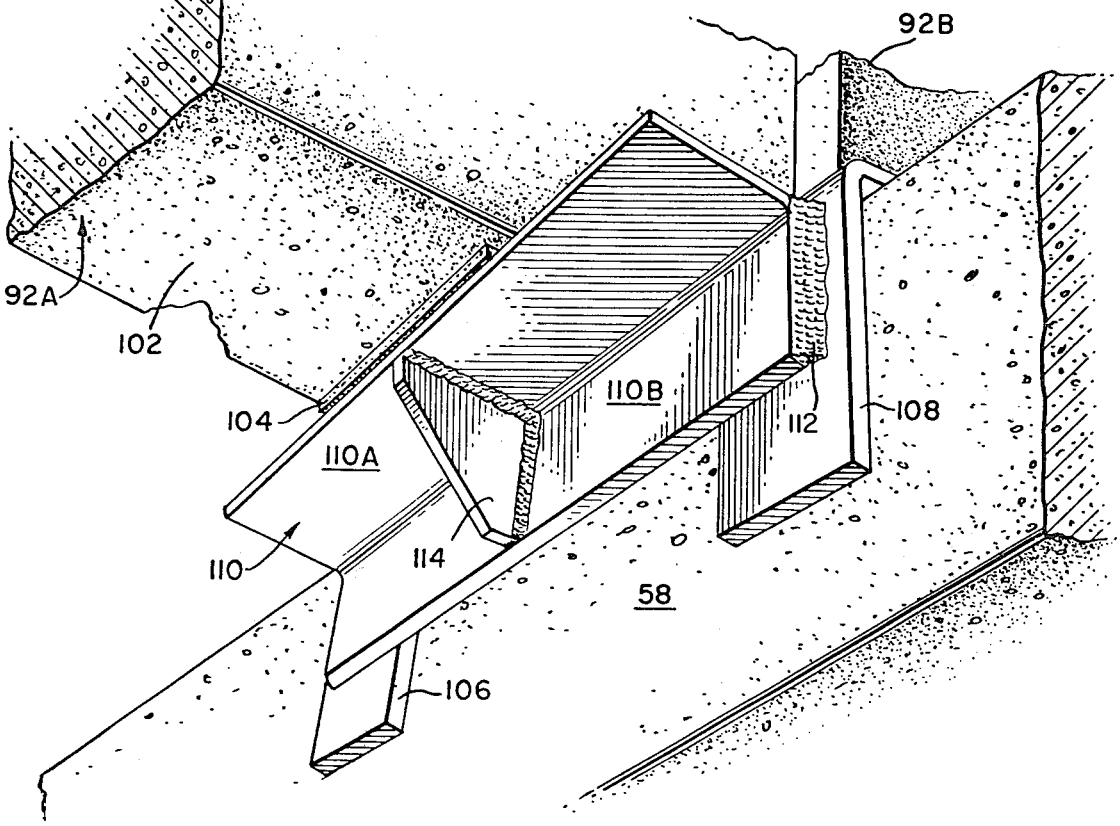
FIG. 8 is a fragmentary bottom perspective view of the supports in use on the construction shown in FIG. 6.

The radial ends $R^1$ and $R^2$ of shaped panels 92A and 92B forming the radial bent panel sections rest upon upper surfaces 58A of beam members or sections of the radial bent sections, the latter being shown in FIGS. 7 and 8, by means of the downwardly depending T-beam section legs 102 having the bottom surfaces 102A effectively supported on these top beam surfaces.

Since the radial beams and the T-beams are constructed of precast concrete, and since a normal expansion and contraction of parts is realized under working and weather conditions, there is a moving rubbing or grating action where the parts are in supportive or other contact. Desirably a friction reducing pad or the like would be placed between the various members to allow for their movement with respect to one another while preventing damage to the parts.

Figure 4:
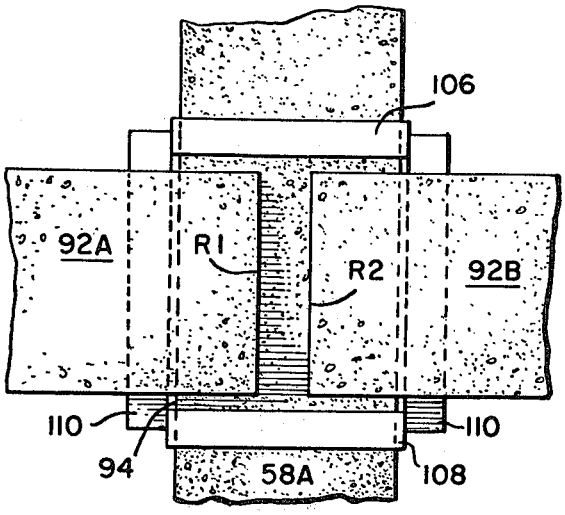
FIG. 4 is a fragmentary plan view of an intersection of a type shown in FIG. 3, and of a proper damage preventing construction.
Figure 5:
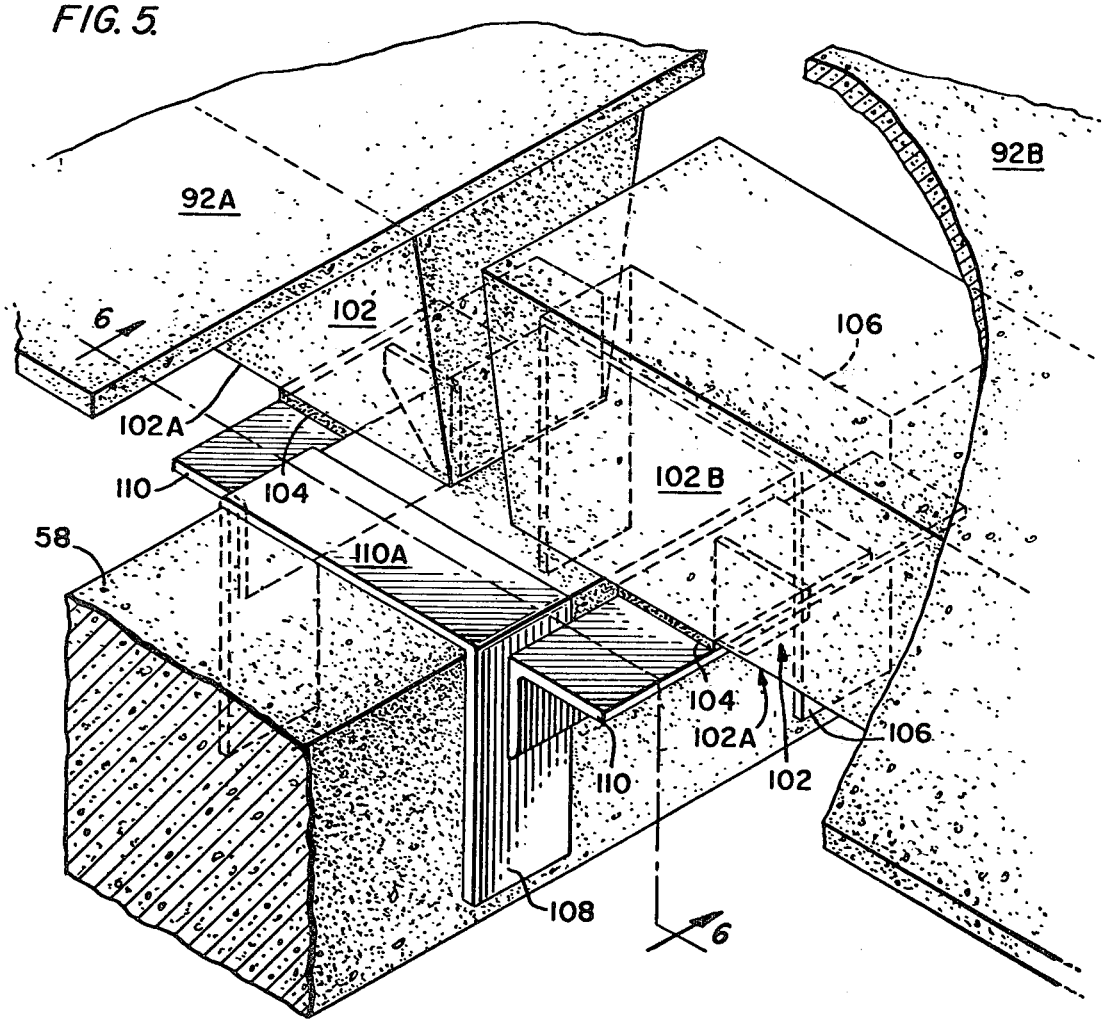
FIG. 5 is an isometric view of the present invention as used at a beam intersection, parts being broken away for clarity.

The design of the erected structure, in some instances at least, omitted pads and caused the problem which is overcome, and/or repaired, by the present invention. Referring to FIG. 5 of the drawings, the actual condition existing when the tower was inspected is there shown. The double T-beam legs 102 had their lower surfaces 102A resting or contacting the upper surfaces 58A of radial beams 58. The beam failure at the corners resulted from failure to insert a neoprene or the like material pad, shown at 104 in FIG. 4, which is a view of the intersecting construction as designed.

As mentioned hereinbefore the existing water tower is a huge 400 foot structure used for cooling steam from a plant's boiler. In operation, water from the station is pumped into the tower, up to a 60 foot level, where it passes over and through the series of concrete beams. Then the water falls down the sides of the tower and through a sieve-like "fill" of concrete and asbestos. This breaks up the water for additional cooling, over and above being subjected to the cross flow of cooling air rising in the tower. When inspected in a periodic check, the cement and asbestos fill had begun to deteriorate and needed to be replaced. After draining the tower, it was discovered that some of the beams, sixty feet up in the tower, had begun to slip. These beams were in danger of falling through into the depths of the tower.

Figure 3:
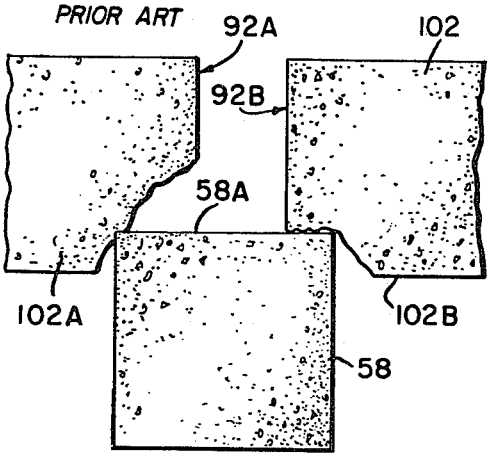

The condition existing, i.e., the omission of the neoprene pads resulted in the double T-beam legs resting directly on the radial bent beams, and due to end lower corner deterioration (FIG. 3) could have resulted, if the condition were permitted to remain, in the T-beams falling off the radial beams entirely as the erosion continued.

The failure of the T-beams is a result of the fact that the concrete to concrete bearing surface did not allow them to move with respect to one another. Stresses then developed in the connection which resulted in the spalling or chipping and breaking away of the concrete at the ends. As the edges of the beams broke away, the beams began to drop. This deterioration was aggravated by both freeze/thaw action and the effect of salt in the water, since the cooling tower uses tidal rinse water. It was imperative then that the double T-beam must be either replaced or given support in some fashion. In the absence of actual continued shut down and beam replacement, a repair plan initially was felt to reside in hanging of the new fill from the damaged beams, and in order to avoid costly and time consuming replacement of the beams, a quick, yet permanent, solution to the problem was necessary. Replacement of the beam at this time was just not considered practical in the time available.

To this end the support bracket of the invention was devised. Basically, as will be seen in FIGS. 5–8, and from the following description thereof, the repair bracket is a stainless steel device which can be referred to as a "cooling tower support bracket". The material used can, of course, be varied under varying requirements and operating conditions. Basically the problem could have been avoided by the insertion of the neoprene pads 104 between the legs 102 of the T-beams and radial beams 58, as shown in FIG. 1. It is felt, however, that the present invention not only serves to repair the present damage and prevent further damage but additionally serves to give additional strength and safety to this particular structure, and the principles are applicable to other structural situations involving the support of one member on another, especially with abrasive material, and superposed in a crossing disposition.

The solution to the problem at hand, and which results in the present invention, basically or broadly comprises a steel, or the like, bracket fitted over the support, or radial bent beam, with the legs of the T-beam resting on top of the support beam, and with a rubber, such as neoprene, pad between the two beams and the bracket. This allows adequate support of the T-beams and further expansion to occur, without added deterioration of the beams. The construction of the bracket is such that an expeditious repair was possible, and there was no necessity to substantially raise the T-beam in the existing construction, but only sufficiently to insert the pad in place. In new construction the placement of the pad can be effected during construction.

Referring now more specifically to FIGS. 5, 6, 7 and 8 of the drawings, a repair situation is shown in FIG. 5. The support bracket of the invention includes two steel straps 106, 108 of an inverted U-shape placed in position over the radial or support beam 58, spaced on opposite sides of the legs 102 of the T-beam. The straps are resting on the undamaged beam. An angle iron 110 is then offered up or placed beneath the deteriorated ends 92A and 92B of the T-beam to support the T-beam, and the legs of the angle then welded to the strap as shown at 112 in FIG. 8. A brace member 114 is fixed by welding between the horizontal and vertical portions 110A and 110B respectively of brace 110. A neoprene pad 104 is placed between the brace and leg. The brace offers support to the T-beam, and the pad between the concrete beam and the steel beam allows free movement of the T-beam with respect to the support beam through bracket 110.

Figure 6:
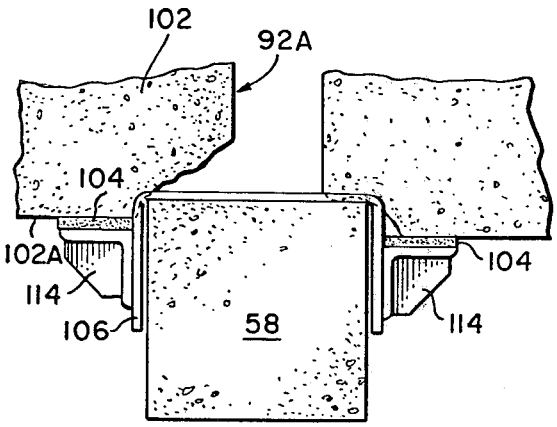
FIG. 6 is a fragmentary sectional view on line 6—6 of FIG. 5.

The broken away isometric view of FIG. 5 discloses more clearly a repair situation such as shown in FIG. 6, with the support bracket in place. The normal intended construction, not necessitating a bracing support, is shown in section in FIG. 7.

FIG. 8 is a bottom perspective view of the support bracket of the invention as assembled in operative relation to the support beam and legs of the T-beam.

As will be obvious, the present support bracket can be used for repair of an existing structure; for strengthening a structure; or incorporation in a new structure.

The bracket material used in the existing tower was 316L stainless steel. This material was used due to the corrosive nature of the material passing through the tower. In normal circumstances a carbon steel, or similar material, could be used and accomplish the desired end result.

While the solution shown and described was particular to a specific cooling tower to support a decaying T-beam, there are general applications in many structures, particularly where one concrete beam rests on another beam. Some such areas of use could be in, for example, roofing slabs in warehouses, or to support beams in any form of precast concrete structure.

The purpose of the device was initially in a repair capacity where it was impractical to replace a member with a new one.

In addition, it is very useful during tight scheduling when, if a beam is made too short, such that it could not rest on a support beam, the support bracket could be appropriately installed and allow construction to progress without waiting for a new member of the correct size.

It will be obvious that the bracket can be installed for repair in existing structures by placement of the relative parts in position, with subsequent welding of the parts, or the bracket can be preassembled for new or appropriate structures.

Manifestly minor changes and modifications can be made in the structure as herein shown and described without departing from the spirit and scope of the invention as defined in the appended claims.

We claim:

1. The method of supporting an end of a first precast concrete beam on an underlying supportive second precast concrete beam at an angle to said first beam, comprising placing inverted straps over the second underlying beam adjacent the ends of said first beam, fixedly attaching an angle member to and between said straps, said angle having a vertical leg which is attached to said straps and a horizontal leg in operative underlying supportive engagement with the underside of first beam.

2. In the method of claim 1 including placing a resilient pad between the horizontal leg of the angle and the underside of the beam to facilitate movement thereof.

3. In the method of claim 2, said first beam being a multiple T-beam, the legs thereof being in supportive engagement.

4. A building structure comprising a first supported beam, a second beam in supportive engagement with said first beam, said beams being in relative movable contact at the position of engagement therebetween relative movement of one said beam with respect to the other beam subjecting a beam portion to possible deterioration, a U-shaped strap passed over the underlying supportive beam in inverted mounted position thereon and proximate said supported beam, said strap having a supportive angle member with a flange portion being in operative supportive contact with the underside of said supported beam, the supportive engagement of said supportive angle member permitting a degree of relative movement of one said beam with respect to the other said beam with minimized deterioration of a said beam portion.

5. A building structure as claimed in claim 4 wherein the beam portion subject to deterioration is a beam end.

6. A building structure as claimed in claim 4, and wherein said beams are of concrete construction, whereby the relative movement will tend to cause deterioration and wearing away of the beams at, and adjacent to, points of contact therebetween.

7. A building structure as claimed in claim 6 wherein said beams are constructed of precast concrete.

8. A building structure as claimed in claim 6, including a pad of resilient material inserted between said supportive flange and the underside of the beam in supportive contact therewith to facilitate the said relative movement between the said beams.

9. A building structure as claimed in claim 8, wherein an end of the first overlying beam is supportively positioned on the underlying second beam, and is in operative supportive engagement with said resilient material pad.

10. A building structure as claimed in claim 9, wherein spaced ends of adjacent overlying beams are supportively positioned on the underlying beam, and each said end is in operative supportive engagement with a resilient pad on said flange to permit relative movement of the said beams in the absence of end deterioration thereof.

11. A building structure as claimed in claim 10, wherein said angle member is welded to said strap.

12. A building structure as claimed in claim 11, including two said straps placed over said supporting beam on either side of said supported beam, said angle member being connected to each said strap.

13. A building structure as claimed in claim 12, said angle member having a vertical leg welded to said strap, and a horizontal leg in underlying operative supportive position under the overlying said beam.

14. A building structure as claimed in claim 13, and including an angular brace engaged with and connected to and between the vertical and horizontal legs of said angle member for strengthening of said horizontal leg in its supportive engagement.

15. A building structure as claimed in claim 14, said bracket being of stainless steel for operable use in a corrosive surrounding environment.

* * * * *